US010172464B2

(12) United States Patent
Cassaday

(10) Patent No.: US 10,172,464 B2
(45) Date of Patent: Jan. 8, 2019

(54) CHAIR

(71) Applicant: Terry Cassaday, Mississauga (CA)

(72) Inventor: Terry Cassaday, Mississauga (CA)

( * ) Notice: Subject to any disclaimer, the term of this patent is extended or adjusted under 35 U.S.C. 154(b) by 0 days.

(21) Appl. No.: 15/405,963

(22) Filed: Jan. 13, 2017

(65) Prior Publication Data

US 2017/0127839 A1 May 11, 2017

Related U.S. Application Data

(63) Continuation-in-part of application No. PCT/CA2015/050771, filed on Aug. 13, 2015.

(60) Provisional application No. 62/404,856, filed on Oct. 6, 2016, provisional application No. 62/066,440, filed on Oct. 21, 2014, provisional application No. 62/036,805, filed on Aug. 13, 2014.

(51) Int. Cl.

| | |
|---|---|
| ***A47C 7/35*** | (2006.01) |
| ***A47C 7/14*** | (2006.01) |
| ***A47C 7/46*** | (2006.01) |
| ***A47C 7/28*** | (2006.01) |

(52) U.S. Cl.

CPC ..... *A47C 7/35* (2013.01); *A47C 7/14* (2013.01); *A47C 7/282* (2013.01); *A47C 7/46* (2013.01)

(58) Field of Classification Search

CPC .. A47C 7/35; A47C 7/14; A47C 7/282; A47C 7/46

See application file for complete search history.

(56) References Cited

U.S. PATENT DOCUMENTS

| | | | | |
|---|---|---|---|---|
| 4,883,320 | A * | 11/1989 | Izumida | A47C 7/282 297/284.1 |
| 6,609,755 | B2 * | 8/2003 | Koepke | A47C 1/03255 297/300.1 |
| 6,957,861 | B1 * | 10/2005 | Chou | A47C 3/025 297/284.7 |
| 7,434,888 | B2 * | 10/2008 | Lin | A47C 7/282 297/452.13 |
| 7,731,295 | B2 * | 6/2010 | Lin | A47C 7/282 297/452.13 |
| 7,837,265 | B2 * | 11/2010 | Machael | A47C 1/023 297/300.2 |

(Continued)

FOREIGN PATENT DOCUMENTS

CA 2319884 C 12/2001

OTHER PUBLICATIONS

International Preliminary report, Written Opinion, International Application No. PCT/CA2015/050771, 6 pages, dated Feb. 14, 2017.

*Primary Examiner* — Philip F Gabler
(74) *Attorney, Agent, or Firm* — Dinsmore & Shohl LLP

(57) ABSTRACT

The invention relates to a chair having a seat structure formed by a frame member that defines a central opening. A flexible membrane extends across the central opening. A pair of support pads, one disposed on either side of the cross-beam member, is provided and arranged at a level below the central opening of the frame member. The support pads are arranged within the seat structure so as to be rearwardly disposed with respect to the front edge of the frame by a first distance and spaced apart from each other by a second distance, the first and second distances generally corresponding to the positioning of the ischicial tuberosity of a user when the user assumes a seated position engaging the seat structure.

17 Claims, 12 Drawing Sheets

(56) References Cited

U.S. PATENT DOCUMENTS 7,878,590 B1 * 2/2011 Bilak ..... A47C 7/462
297/284.2

* cited by examiner

CHAIR

CROSS-REFERENCE TO RELATED APPLICATIONS

This Application claims the benefit of U.S. Provisional Application 62/404,856 filed on Oct. 6, 2016. This Application is a Continuation-in-part of Application PCT/CA2015/050771 filed on Aug. 13, 2015. Application PCT/CA2015/050771 claims the benefit of U.S. Provisional Application 62/066,440 filed on Oct. 21, 2014. Application PCT/CA2015/050771 claims the benefit of U.S. Provisional Application 62/036,805 filed on Aug. 13, 2014.

FIELD OF THE INVENTION

This disclosure relates to the field of ergonomic chairs.

BACKGROUND OF THE INVENTION

Ergonomic chairs for reducing various stresses on the body that are often related to sitting for long periods of time and/or due to incorrect posture when in the seated position are known and come in a variety of designs. Mesh chairs that provide a mesh or material covering formed from a resilient material that is arranged over a chair frame for supporting the user in the seated position have gained popularity, at least in part for their modern aesthetics. Mesh chairs are also considered advantageous for allowing air flow through the mesh or material covering enabling the user to remain cool when seated in the chair for long periods of time and for being more easily cleaned and/or sterilized than more traditional chairs that include more fabric and cushioning.

SUMMARY OF THE INVENTION

Forming one aspect of the invention is a chair comprising a base, a support post extending upwardly from said base; and a seat structure attached to said support post. The seat structure comprises: a frame member defining a central opening; a flexible membrane extending across the central opening of said frame member; and a pair of support pads arranged at a level below the central opening of said frame member.

According to another aspect, the support pads can be rearwardly disposed with respect to the front edge of said frame member by a first distance and are spaced apart from each other by a second distance, the first and second distances generally corresponding to the positioning of the ischicial tuberosity of a user when the user assumes a seated position engaging the seat structure.

Forming another aspect of the invention is a chair comprising a base and a seat structure attached to said base. This seat structure includes: a frame member defining a central opening; a flexible membrane extending across the central opening of said frame member; and a pair of support pads arranged at a level below the central opening of said frame member.

Forming yet another aspect of the invention is a chair comprising a base, a seat structure attached to said base to support the buttocks of a user seated thereupon; and a back rest attached to one or more of the base and the seat structure to support the back of the user. The back rest includes: a frame member defining a central opening; a flexible membrane extending across the central opening of said frame member; and a pad arranged behind the central opening and positioned in the manner of a lumbar pad.

DETAILED DESCRIPTION OF THE PREFERRED EMBODIMENTS

Figure 1:
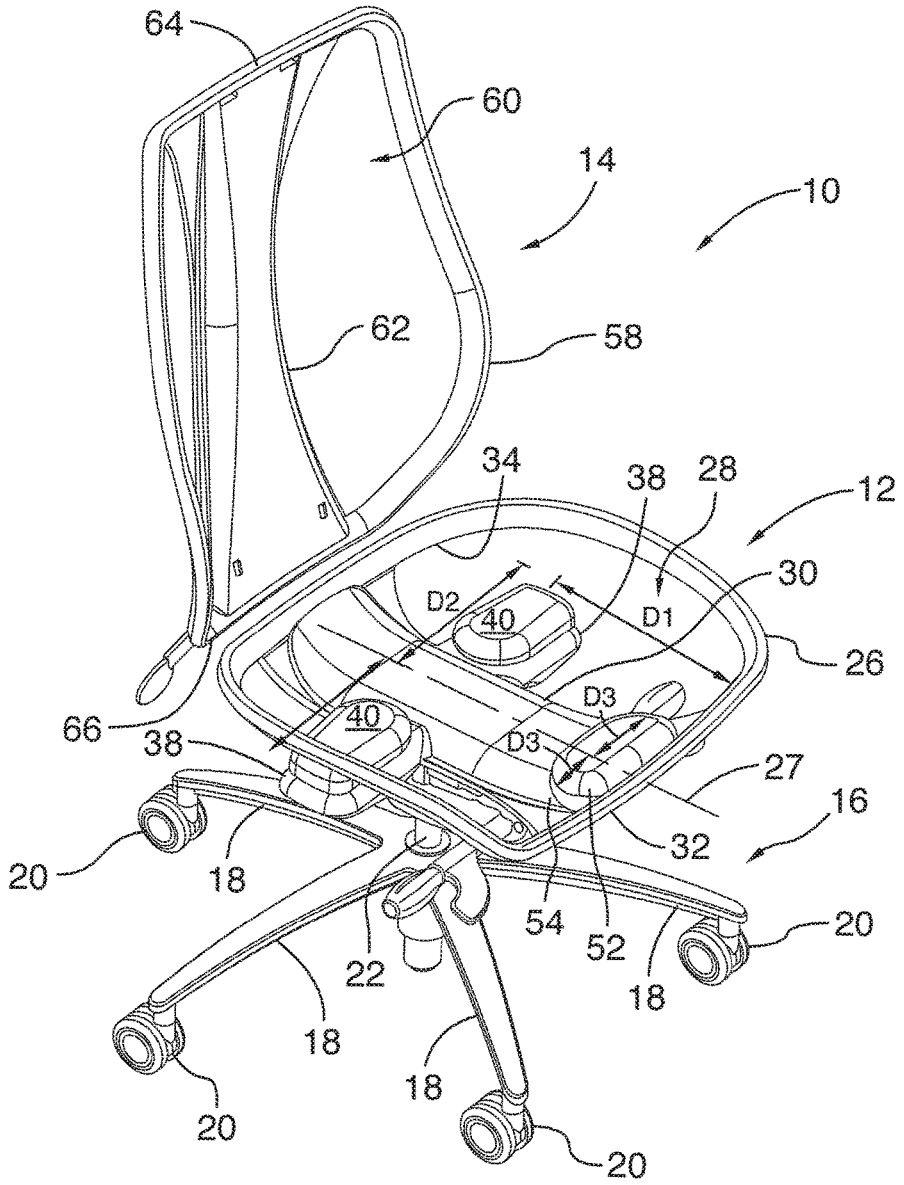
FIG. 1 is a perspective view of a chair frame with seat structure according an exemplary embodiment of the present disclosure.
Figure 2:
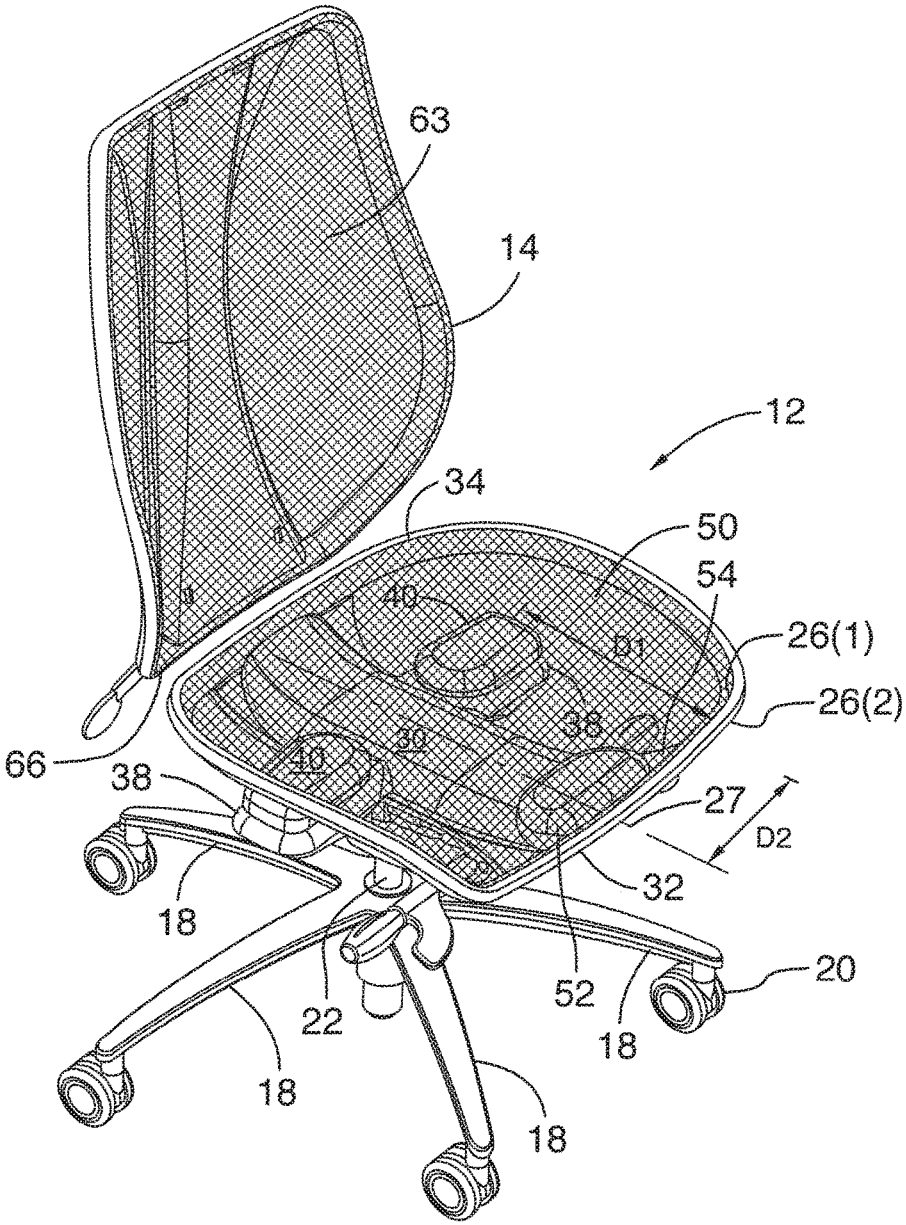
FIG. 2 is a detail perspective view of the seat structure of the chair according to the exemplary embodiment of FIG. 1.

Referring now to FIGS. 1 and 2 there is shown a chair 10 according to an exemplary embodiment of the present disclosure. The chair 10 includes a seat structure 12, a back rest 14 and a base 16. The base 16 includes a plurality of radially spaced apart legs 18 each of which is provided with a caster or roller 20, the base 16 therefore providing rolling support to the chair 10. A support post 22 extends upwardly from the center of the base 16 and typically includes a height-adjusting mechanism for allowing the overall height of the seat structure 12 to be adjusted based on the needs of the individual user in accordance with principles known in the art.

The seat structure 12 is mounted at the upper end of the support post 22. The seat structure 12 includes a frame member 26 that forms the periphery of the seat and defines a central opening 28 therethrough. A cross-beam member 30 having a generally concave or curved structure extends generally below the central opening 28 of the frame member 6 along the midline or centerline 27 of the seat structure 12 interconnecting the front and rear edges 32, 34 of the frame member 26, the cross-beam member 30 serving to mount the seat structure 12 to the upper end of the support post 22. The frame member 26 and cross-beam member 30 may be integrally formed or may be formed as separate components that are fixed together forming the seat structure. The frame member 26 and cross-beam member 30 are formed of molded plastic material.

A pair of cushion supports 38 extend laterally away from the cross-beam member 30, one on either side of thereof. The cushion supports 38 are rearwardly disposed by a distance D1 with respect to the front edge 32 of the frame member 26 and extend laterally away cross-beam member 30 by a distance D2 with respect to the midline or centerline 27 of the seat structure 12. The distances D1 and D2 are predetermined so as to generally correspond to and/or align with the position or general location of the ischicial tuberosity, or sitting bones, of the average user when in a seated position.

The cushion supports 38 are formed as separate components that are securely fixed to the cross-beam member 30. First and second support cushions 40 are secured to the upper surface 42 of the cushion supports 38 and are formed from a suitable padded material to provide a cushioning effect. The cushion supports 38 and support pads 40 are selected and/or together have a predetermined overall thickness or height to ensure that the upper surface 44 of the support cushions 40 lies at a level below the central opening 28 of the frame member 26 when arranged or mounted on the cushion supports 38.

As shown in FIG. 2, a thin, flexible membrane 50 is arranged so as to extend across the central opening 28 of the frame member 26. The membrane 50 is generally formed from a resilient mesh fabric that is stretched across the central opening 28 and affixed to the frame member 26.

It is generally understood that a person in a seated position rests on the ischicial tuberosity, or sits bones, which extend from the lower, back portion of the pelvis or hip bones. When a person is standing, the ischicial tuberosity is generally covered by large muscle groups that generally provide cushioning or padding to the otherwise bony protrusions of the ischicial tuberosity. However, when a person assumes a seated position, the muscles tend to shift leaving the bony protrusions of the ischicial tuberosity to bear the majority of the weight. Bearing the majority of one's weight on the ischicial tuberosity can be quite uncomfortable especially when one is in a seated position for a long duration of time, as is often typical of an office workplace situation. As well, depending on the size and overall weight of the user, when mesh is utilized, it has been discovered that pressure points may also be created against the backs of the user's legs and/or on their hips or thighs where the edges of the frame member may come into contact with and impinge on the user's body.

In the embodiment shown in FIG. 1 and FIG. 2, the cushion supports 38 and support pads 40 are strategically arranged in relation to the cross-beam member 30 in order to reduce the pressure points associated with the membrane 50. In particular, the cushion supports 38 together with the support pads 40 provide support to the membrane 50 when the membrane 50 becomes stretched under the weight of a user. The arrangement of the cushion supports 38 and support pads 40 in relation to the cross-beam member 30 underneath the membrane 50 also prevents the membrane 50 from bottoming-out under the weight of a larger and/or heavier individual. Accordingly, should a larger and/or heavier individual assume a seated position on the chair 10, the user will end up resting on the support pads 40 and enjoy the comfort of the padded material forming the support pads 40 as opposed to bottoming-out the seat structure 12 and finding themselves resting on the cross-beam member 30. Accordingly, cushion supports 38 and support pads 40 together provide additional support to the membrane 50 which allows the seat structure 12 to provide the benefits associated with a mesh-style chair since the membrane 50 can stretch and conform to the shape of the user when the user assumes a seated position bearing weight on the membrane 50 and allow for air-flow through the mesh-material forming the membrane 50, but still offers the added benefit of support and cushioning to the sits bones or ischicial tuberosity of the user. The cushion supports 38 and support pads 40 also serve to reduce the overall amount of shear stress on the membrane 50 which reduces the likelihood of the frame member 26 impinging on the user and creating uncomfortable pressure points that can have an adverse effect on the overall comfort and ergonomic health of the user. It has also been found that incorporating cushion supports 38 and support pads 40 underneath the membrane 50 prevents the user from sinking too low within the central opening 28 of the frame member 26 and assuming a less-than-ideal sitting position. As a result, the user is less likely to be inclined to raise the overall height of the seat in an effort to compensate for sinking too low within the central opening 28 which raised seat height would result in an even less ergonomic sitting position.

A third support pad 52 is also provided at the front end 54 of the cross-beam member 30 proximal to the front edge 32 of the frame member 26. The third support pad 52 is arranged so as to generally lie between the user's legs when in the seated position on the chair 10. Accordingly, the third support pad 52 provides additional support to membrane 50 in the area proximal the front edge 32 of the frame member 26 along the centreline or midline 27 of the seat structure 12. The third support pad 52 extends laterally on either side of the centreline or midline 27 of the seat structure 12 by a distance D3 and is generally sized and arranged below the central opening 28 of the frame member 26 so as not to come into contact with the user's legs when seated on the chair 10. The third support pad 52, therefore, provides support to only the membrane 50 at the front edge 32 of the seat structure 12. The third support pad 52 therefore works in combination with the first and second support pads 40 that are arranged within the central area of the seat structure 12 to provide a support triangle for providing additional support the membrane 50 under the weight of a user allowing the membrane 50 to adopt a more comfortable position without undue shear stresses being created in the material resulting in a more ergonomic and a more comfortable feel for users of various overall weights and/or sizes. Reducing the amount of shear stresses created in the membrane 50 when under the weight of a user also tends to increase the life of the material forming the membrane 50 over time.

In the embodiment shown, the back rest 14 is similar in structure to the seat structure 12 in that it comprises a frame member 58 that forms the periphery of the back rest 14 and defines a generally elongated, central opening 60. A back support member 62 extends generally along the centerline or midline of the back rest 14 interconnecting the top and bottom edges 64, 66 of the back frame member 58. A second membrane (not shown) is generally arranged across the top of the frame member 58 so as to extend across the central opening 60 defined by the frame member 58. Similar to the membrane 50 used on the seat structure 12, the membrane for the back rest is formed by a mesh material that can stretch and conform to the shape of the user's back when the user rests against the back rest 14 of the chair. The back rest 14 is mounted to the base 16 by tilt mechanism in order to permit limited, pre-determined movement of the back rest 14 (e.g. forward tilt, backwards tilt) with respect to the base independent of the seat structure 12. The back rest 14 may also be provided with additional features such as an adjustable lumbar support mechanism and/or a head rest (not shown) positioned at the upper edge 64 of the back rest 14.

By providing both a back rest 14 and a seat structure 12 formed by frame members 26, 58 fitted with a resilient mesh membrane 50, 63 arranged across the central openings 28, 60 of the frame members 26, 58 allows for air-circulation around and through both the seat structure 12 and back rest 14. As well, since membranes used for both the seat structure 12 and the back rest 14 are generally spaced apart from the supporting structures (e.g. frame members 26, 58 and cross-beam members 30, 62) forming both the seat structure 12 and back rest 14, the chair 10 can be relatively easily cleaned since the components of the seat structure 12 and back rest 14 are accessible, which is advantageous in environments requiring a degree of cleanliness. Furthermore, by providing a seat structure 12 having a combination membrane and support cushion structure as described above, a comfortable and durable chair 10 is provided that is suited to a wide range of individual users.

Figure 3:
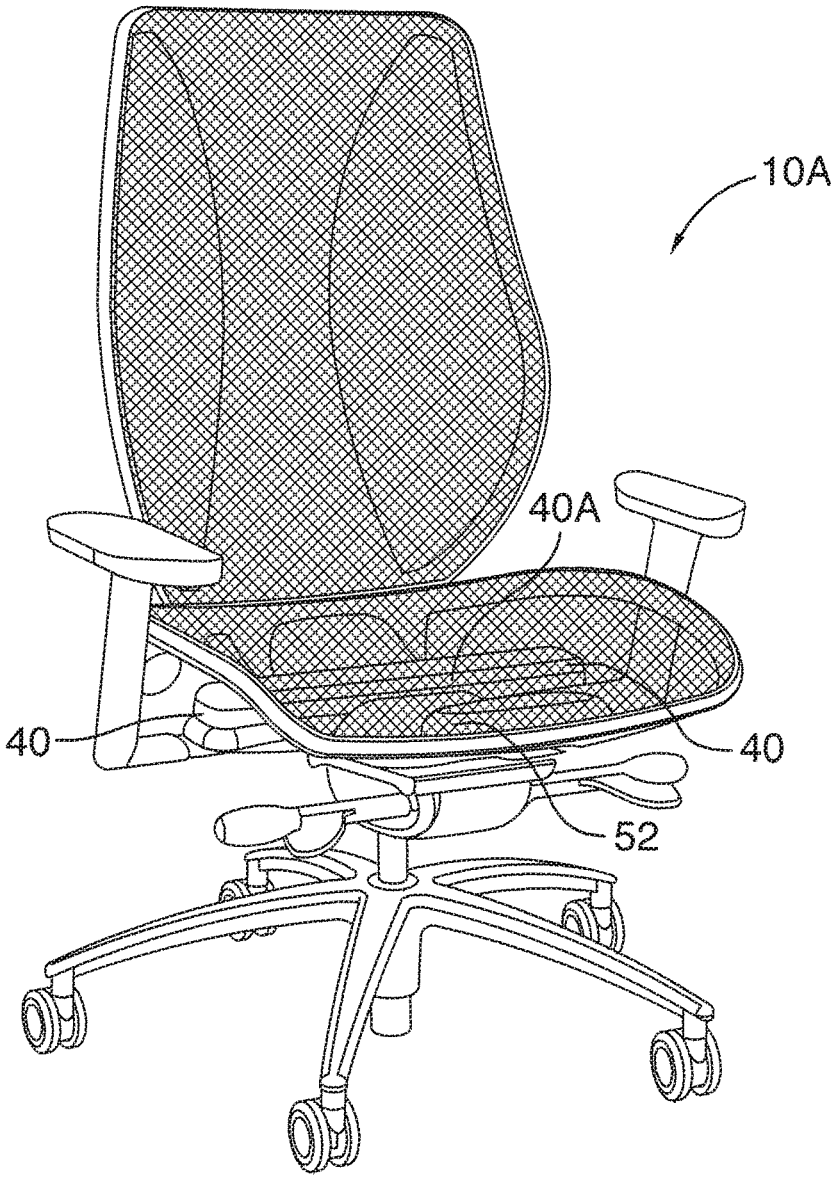
FIG. 3 is a perspective view of a chair frame with seat structure according to a further exemplary embodiment.

A further exemplary embodiment shown in FIG. 3 and designated with general reference 10A. This embodiment is substantially identical to the embodiment of FIGS. 1 and 2, differing only in that first and second support pads 40 are connected by a bridge 40A.

Without intending to be bound by theory, it has been found that an advantageous arrangement of the cushion provided by pads 40 (and 52, when present) is associated with support pads providing the maximum amount of support possible without the user feeling the pads in use. Accordingly, the technology can advantageously be deployed with removable pads of differing densities (to enable users to customize the chair by substitution of pads) or with pads having adjustable air bladders or otherwise adjustable in height relative to the frame or adjustable in stiffness.

Figure 4:
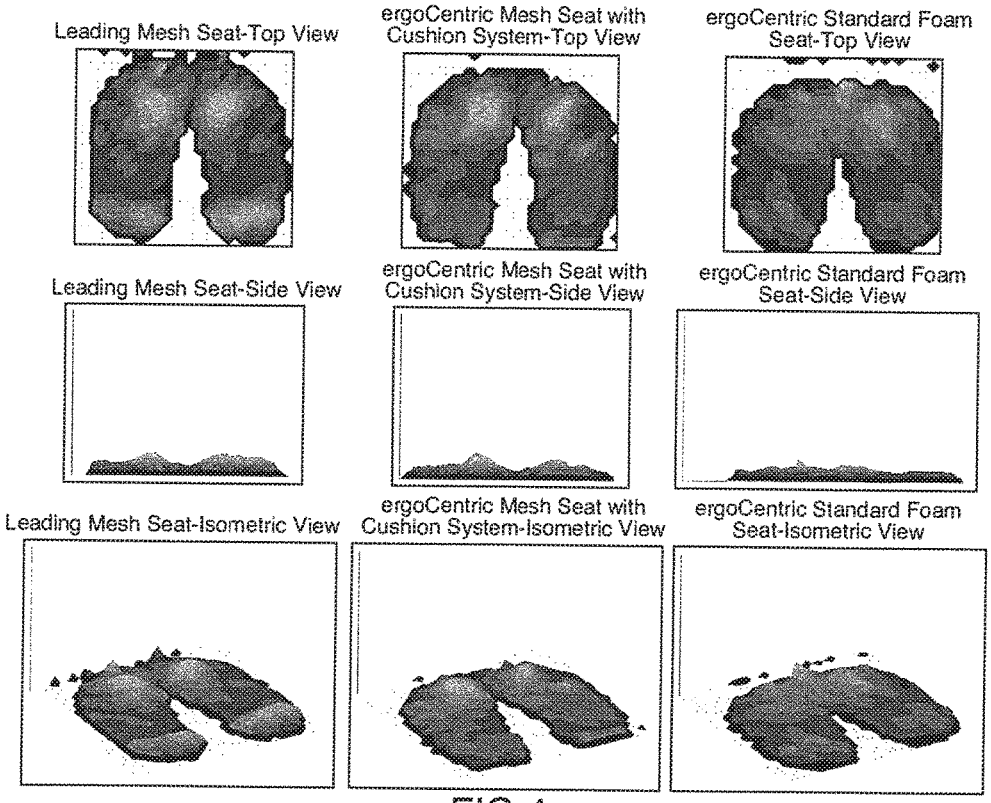
FIG. 4 is a matrix of test results.
Figure 5A:
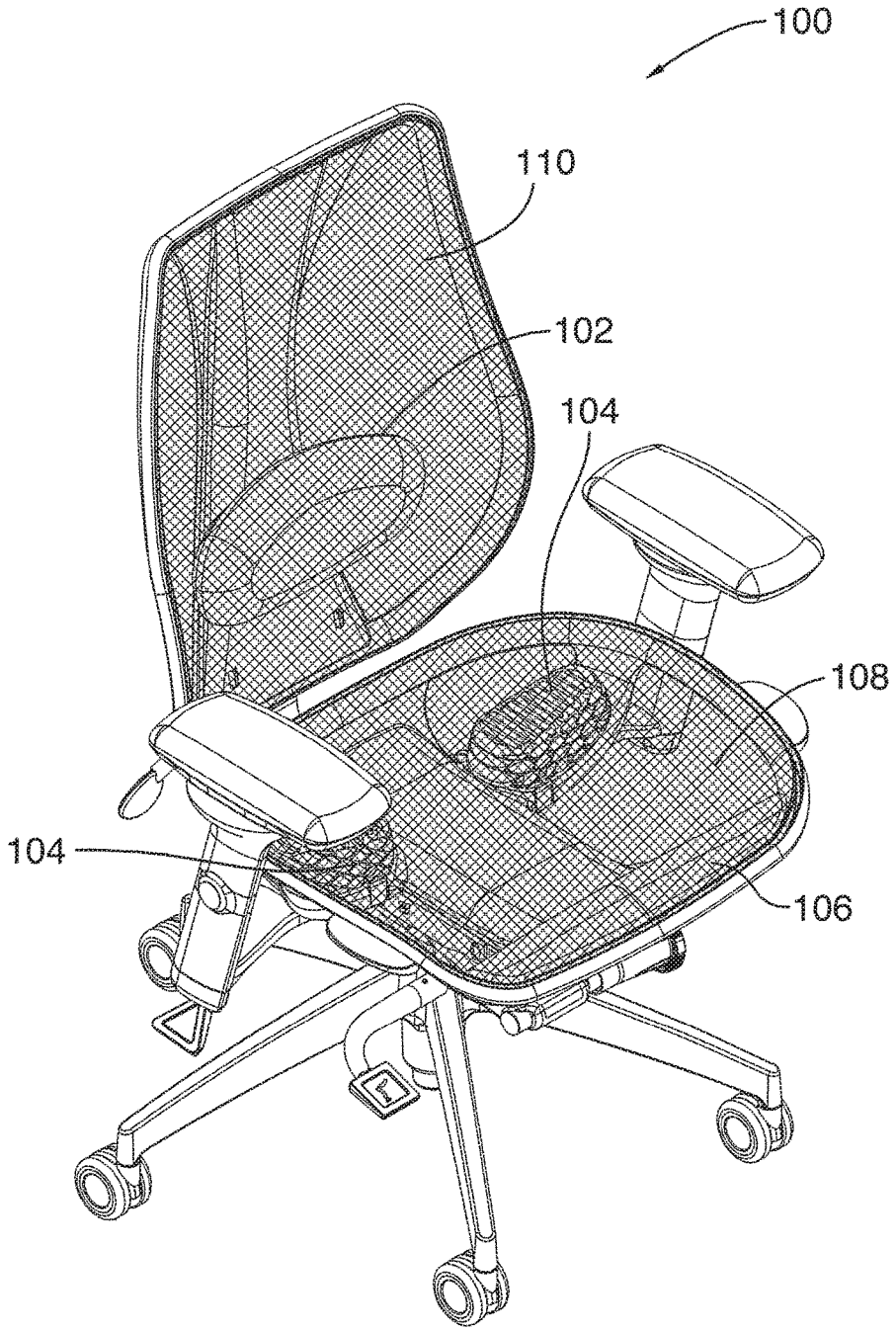
FIG. 5A is a top right front view of a further embodiment.
Figure 5B:
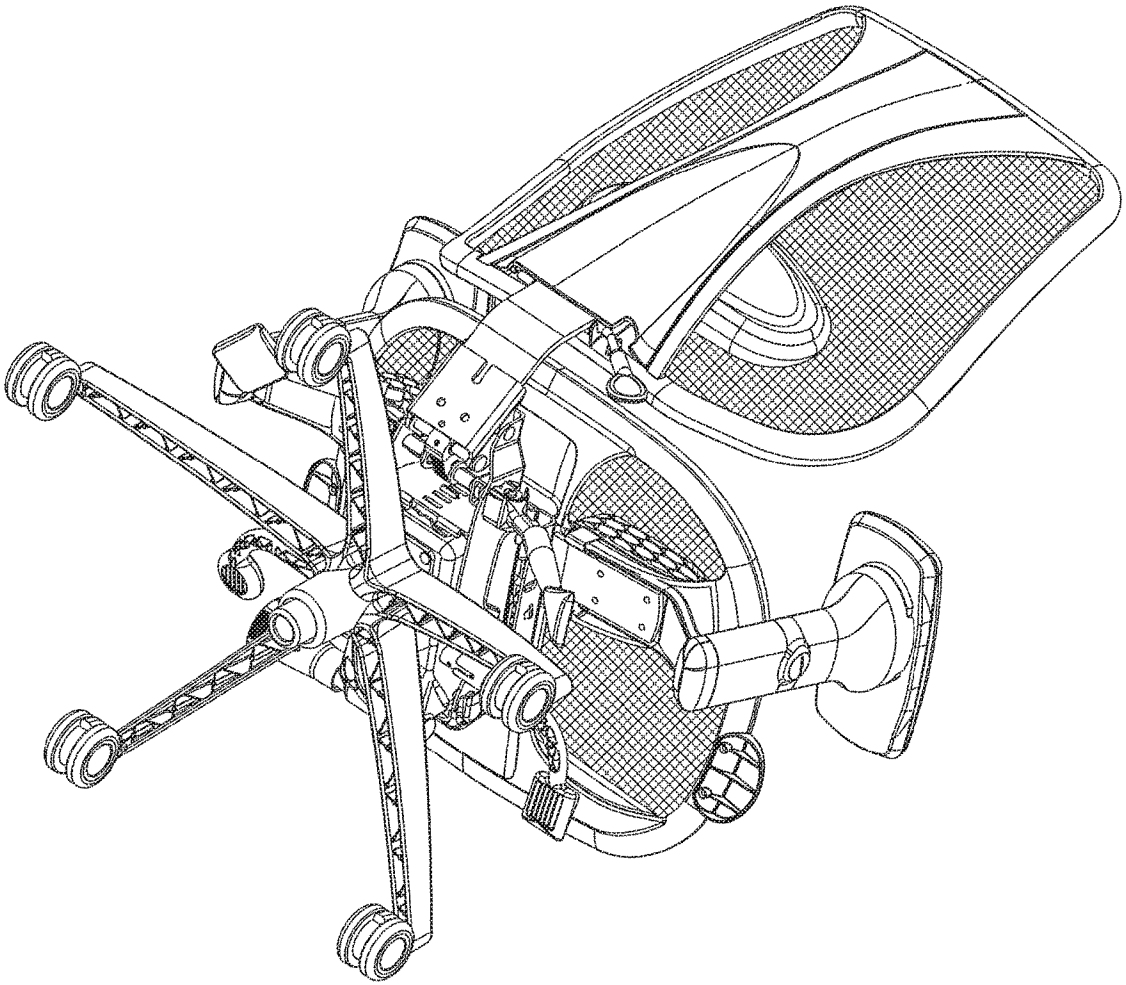
FIG. 5B is a bottom right rear view of the chair of FIG. 5A.
Figure 5C:
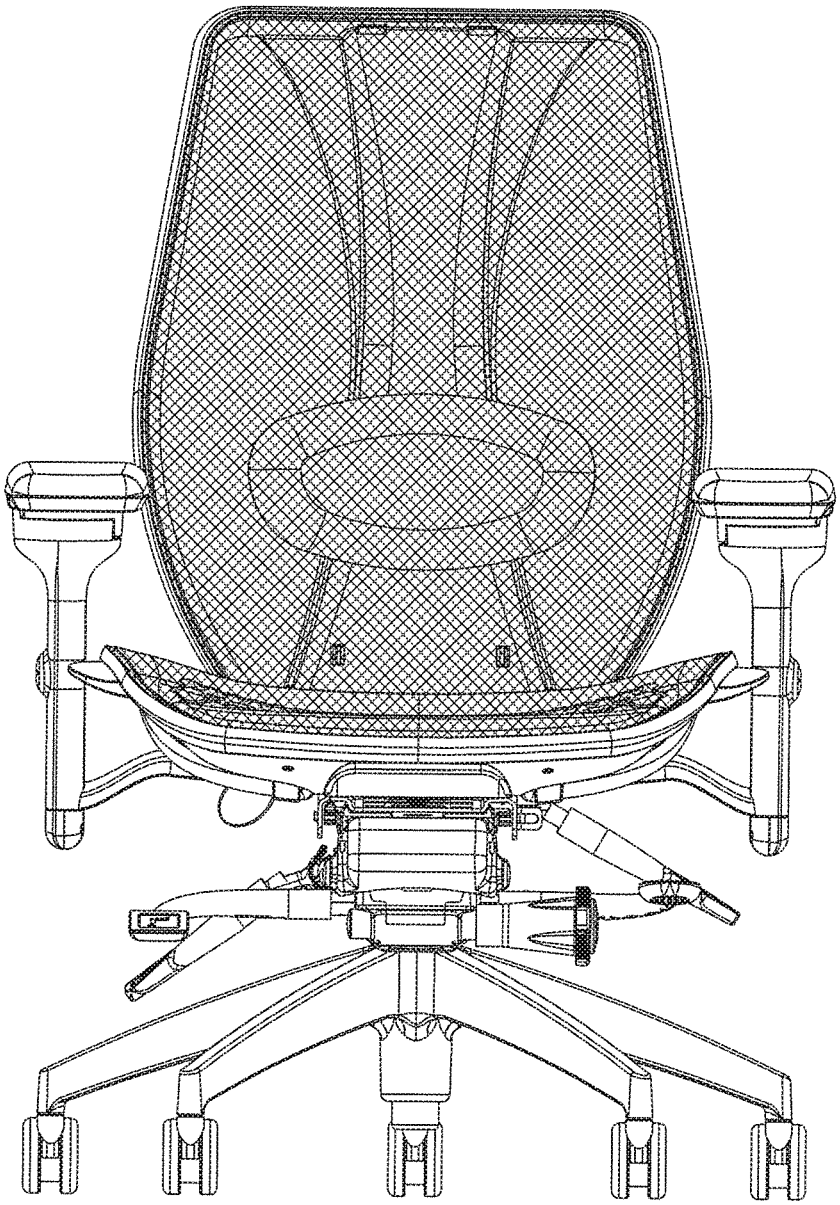
FIG. 5C is a front view of the chair of FIG. 5A.
Figure 5D:
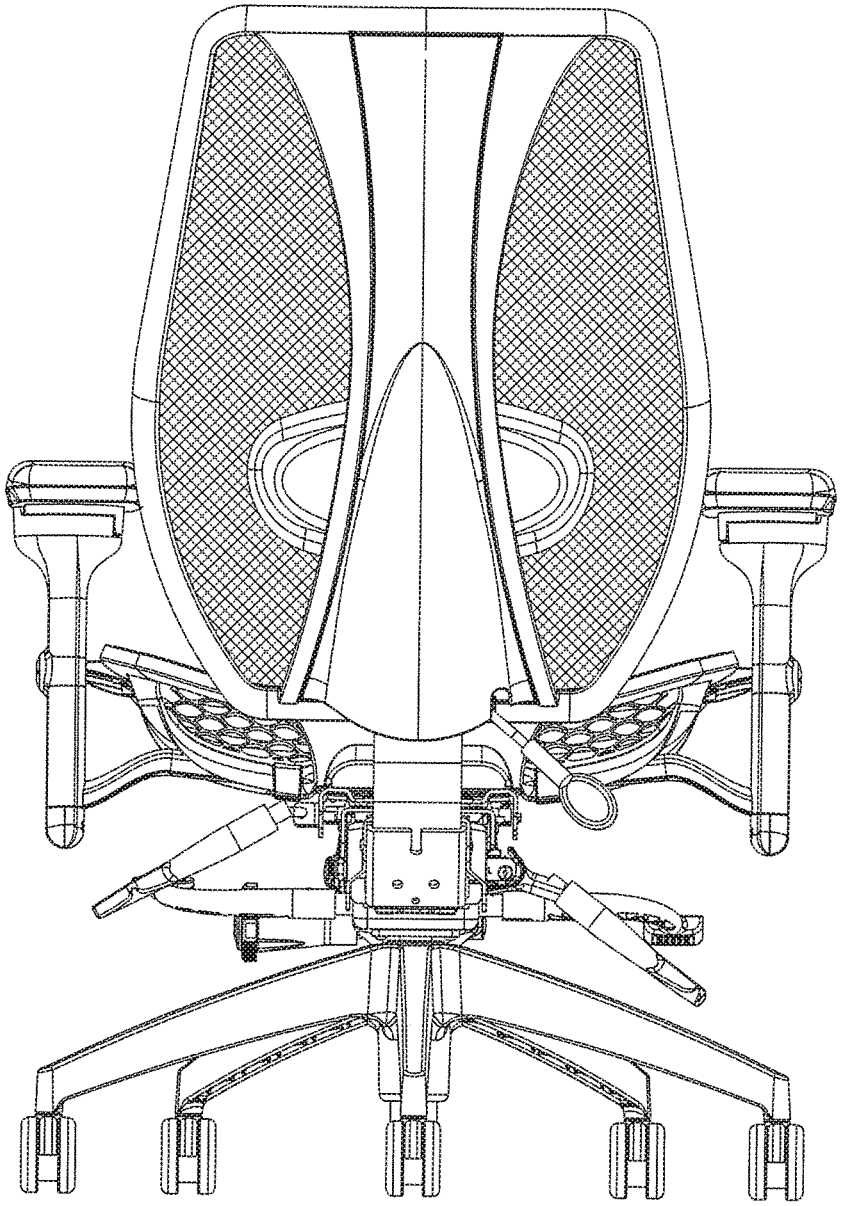
FIG. 5D is a rear view of the chair of FIG. 5A.
Figure 5E:
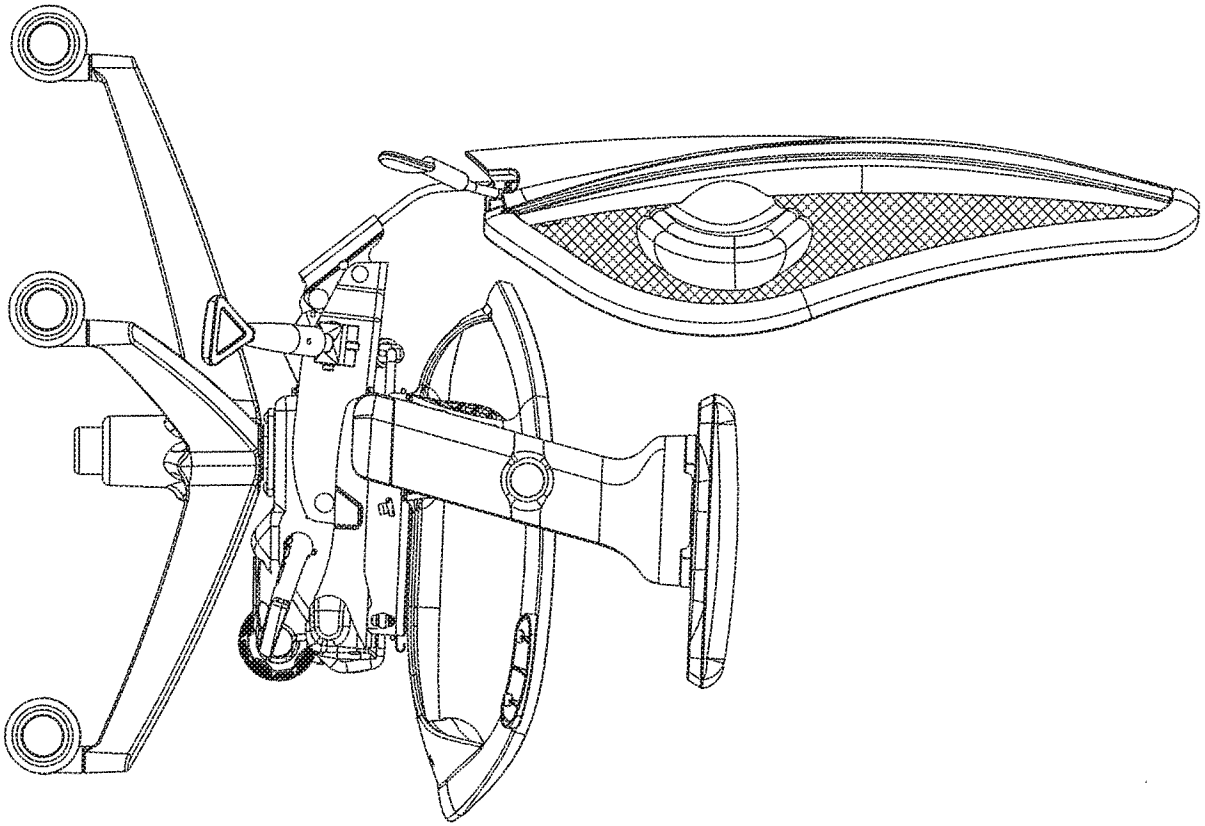
FIG. 5E is a right side view of the chair of FIG. 5A.
Figure 5F:
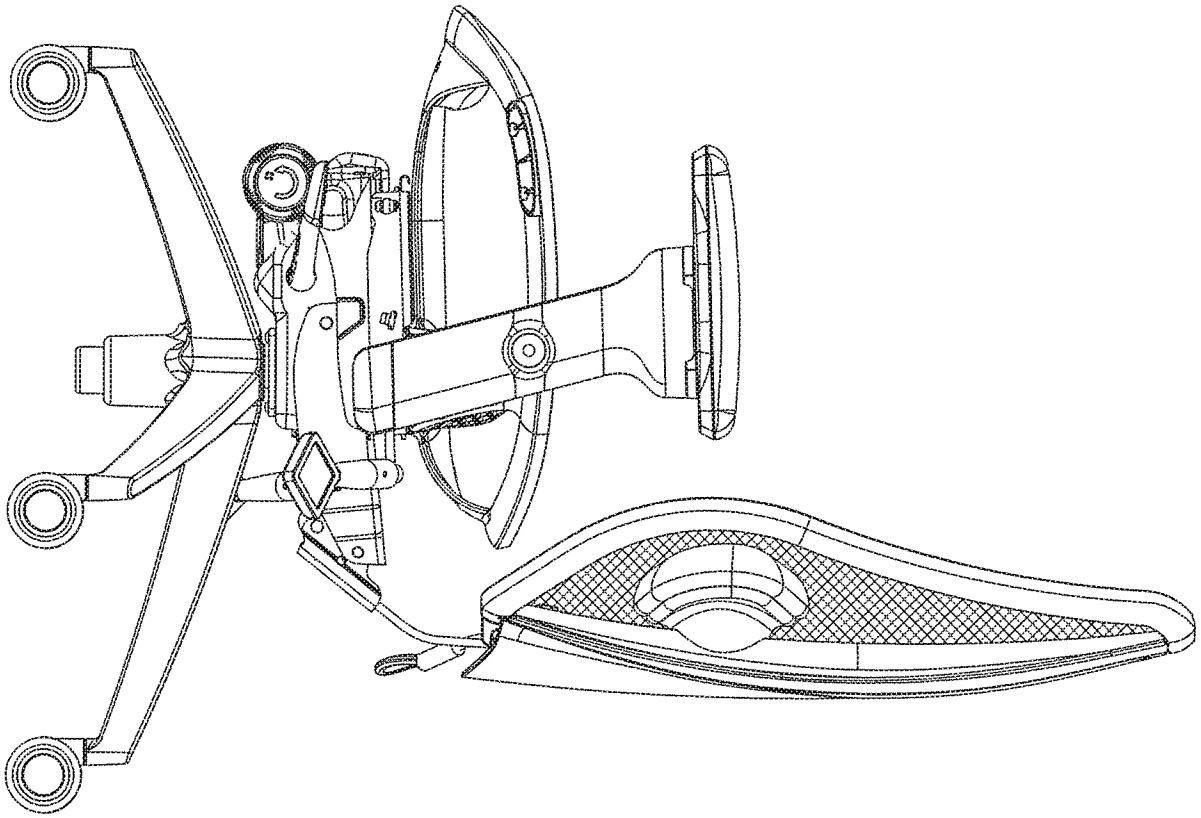
FIG. 5F is a left side view of the chair of FIG. 5A.
Figure 5G:
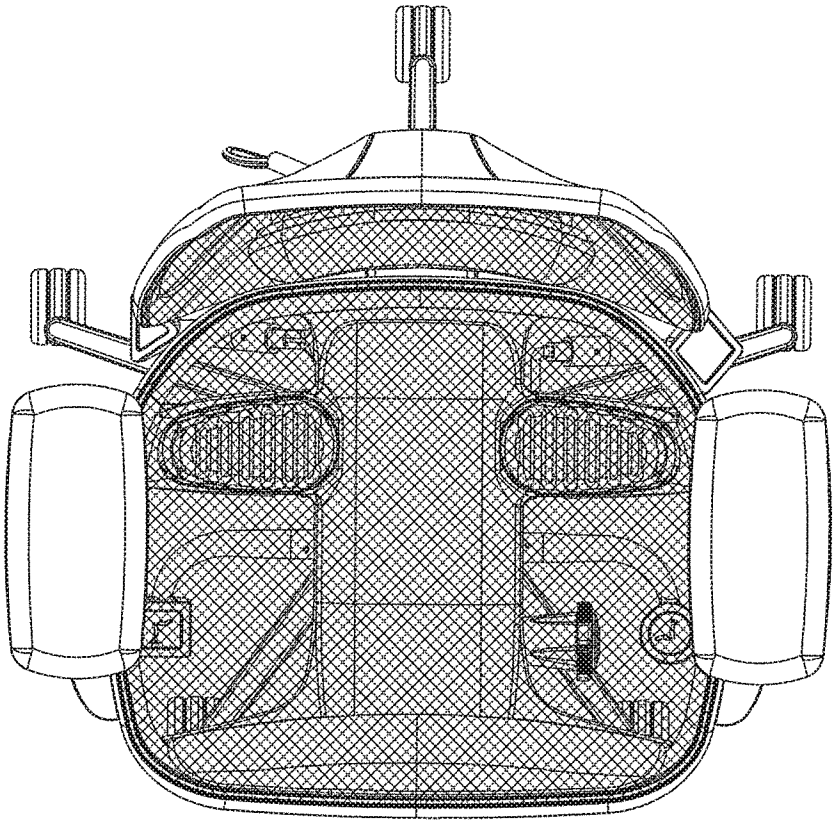
FIG. 5G is a top view of the chair of FIG. 5A.
Figure 5H:
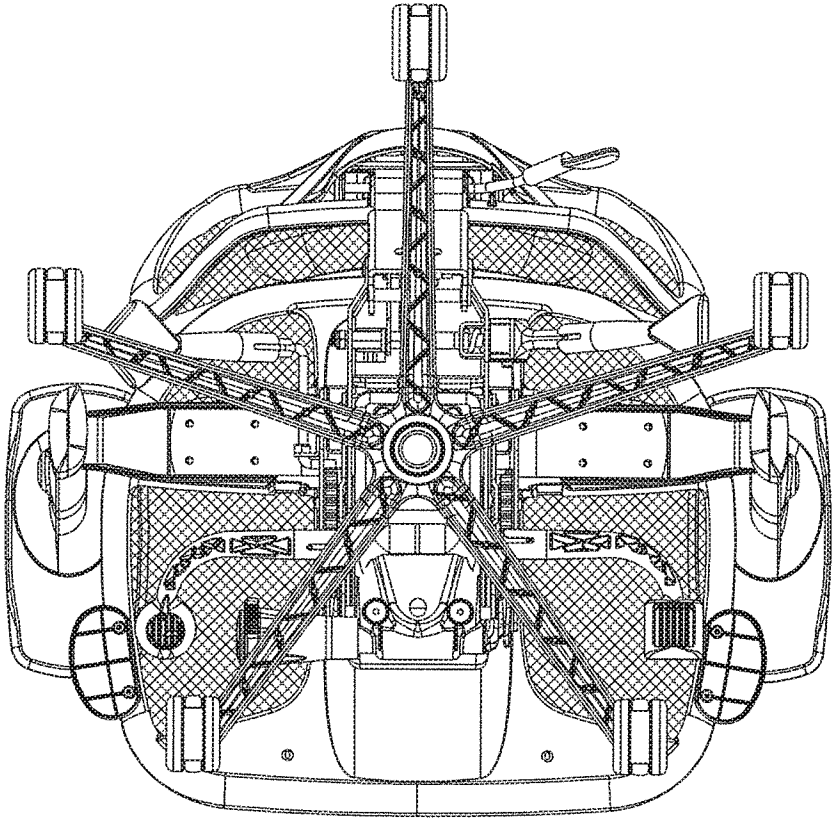
FIG. 5H is a bottom view of the chair of FIG. 5A.

FIG. 4 is a matrix of images showing localized pressure experienced by a user of a leading mesh-only seat [left column], a leading foam-only seat [right column] and a foam-mesh seat according an embodiment of the present invention [central column]. In each column: the uppermost image is a plan view showing localized pressures; the middle age is a side view, which assists in understanding quantum of the pressure differential; and the bottom image is a perspective view. With reference to the left column, it will be seen that, in the leading mesh chair, areas of high pressure exist adjacent the sit bones (the light areas at the top of the uppermost image) and also adjacent under the thighs near the front edge of the chair (the light areas at the bottom of the uppermost image). The leading foam-only seat shows much better distribution, as no areas of very high pressure appear in the images. In the mesh-foam chair tests, the pressure to which the sit bones are exposed has been improved relative to the leading mesh-only chair, and the pressure to which the thighs are exposed at the chair leading edge has been vastly improved relative to the leading mesh-only chair. From the above, it will be evident that significant advantage in pressure distribution can be attained by practising the present invention, but the images shown should be understood to be representative of single samples, only, and are merely included by way of example.

A further embodiment is shown in FIGS. 5A-5H and designated by general reference numeral 100. In this embodiment, each pad is defined by an airless cushion 104 and the third support pad extends across the entire front edge of the seat, as indicated by 106. A lumbar pad 102 is also provided, and is positioned behind the back opening to function in a manner analogous to the ischicial pads. The seat and back are covered with mesh, indicated by 108 and 110, respectively.

While but three embodiments of the chair and seat structure have been illustrated and described, it will be understood that certain adaptations and modifications can be made. For example, whereas the chairs shown each include a support post, this need not be the case; the chair could be made with four legs and non-swivelling.

Therefore, the above discussed embodiments are considered to be illustrative and not restrictive.

The invention claimed is:

1. A chair comprising:

a base;

a support post extending upwardly from said base; and a seat structure attached to said support post;

wherein said seat structure comprises:

a frame member defining a central opening;

a flexible membrane extending across the central opening of said frame member; and a pair of support pads arranged at a level below the central opening of said frame member, said support pads adapted to providing individualized support to a pair of sitting bones of a user;

wherein:

said support pads are rearwardly disposed with respect to a front edge of said frame member by a first distance and are spaced apart from each other by a second distance, the first and second distances generally corresponding to the positioning of the user's sitting bones to establish an ischial tuberosity with said support pads when the user assumes a seated position engaging the seat structure.

2. A chair according to claim 1, wherein said seat structure further comprises cushion supports, the support pads being mounted on said cushion supports.

3. A chair according to claim 2, wherein said cushion supports are one of: integrally formed as part of a cross-beam member or mounted to a cross-beam member.

4. A chair according to claim 1, further comprising a third support pad proximal the front edge of said frame member.

5. A chair according to claim 4, wherein said third support pad is arranged so as to extend between the legs of the user without contacting the legs of the user when the user assumes the seated position engaging the seat structure.

6. A chair according to claim 5, wherein independent tilting mechanisms interconnect both said back rest and said support post and said seat structure and said support post.

7. A chair according to claim 1, further comprising a back rest attached to said support post independent of said seat structure.

8. A chair according to claim 1, further comprising a height adjustment mechanism incorporated in said support post for adjusting the height of said seat structure.

9. A chair according to claim 1, wherein the pads are adjustable in height relative to the frame member.

10. A chair comprising:

a base; and a seat structure attached to said base, the seat structure including:

a frame member defining a central opening;

a flexible membrane extending across the central opening of said frame member; and a pair of support pads arranged at a level below the central opening of said frame member, said support pads adapted to providing individualized supported to a pair of sitting bones of a user;

wherein said support pads are adapted to being positioned the user's sitting bones to establish an ischial tuberosity with said support pads when the user assumes a seated position on the seat structure.

11. A chair according to claim 10, further comprising a third support pad proximal the front edge of said frame member.

12. A chair according to claim 11, wherein said third support pad is arranged so as to extend between the legs of the user without contacting the legs of the user when the user assumes the seated position on the seat structure.

13. A chair according to claim 10, wherein the pair of support pads are formed integrally with one another.

14. A chair according to claim 10, wherein the support pads are defined by airless cushions.

15. A chair comprising:

a base;

a seat structure attached to said base to support the buttocks of a user seated thereupon;

wherein said seat structure further includes:

a frame member defining a central opening;

a flexible membrane extending across the central opening of said frame member; and a pair of support pads arranged at a level below the central opening of said frame member, said support pads adapted to providing individualized support to a pair of sitting bones of a user to establish an ischial tuberosity with the support pads; and a back rest attached to one or more of the base and the seat structure to support the back of the user, the back rest including:

a frame member defining a central opening;

a flexible membrane extending across the central opening of said frame member; and a pad arranged behind the central opening and positioned in the manner of a lumbar pad;

wherein the pad is rearwardly disposed with respect to the central opening such that the pad is spaced apart from the flexible membrane.

16. A chair according to claim 15, wherein the position of the pad is adjustable relative to the frame member.

17. A chair according to claim 1, further comprising:

a cross-beam member extending below the central opening of the frame member and interconnecting front and rear edges of the frame member;

wherein each support pad is mounted on a cushion support that is rearwardly disposed with respect to the front edge of the frame member by the first distance along an axis parallel to a central, midline axis of the cross-beam member and is disposed laterally away from the central, midline axis of the frame member along an axis perpendicular to, or generally perpendicular to, the central, midline axis of the cross-beam member by the second distance such that one cushion support and support pad is disposed on either side of the cross-beam member.

* * * * *